US005573055A

United States Patent [19]

Melling et al.

[11] Patent Number: 5,573,055

[45] Date of Patent: Nov. 12, 1996

[54] WATER DISPERSIBLE MOULDS

[75] Inventors: Richard Melling, Nr Ruthin; Nigel Challand, Mold, both of United Kingdom

[73] Assignee: Borden (UK) Limited, England

[21] Appl. No.: 39,147

[22] PCT Filed: Oct. 15, 1991

[86] PCT No.: PCT/GB91/01793

§ 371 Date: Jun. 15, 1993

§ 102(e) Date: Jun. 15, 1993

[87] PCT Pub. No.: WO92/06808

PCT Pub. Date: Apr. 30, 1992

[30] Foreign Application Priority Data

Oct. 19, 1990 [GB] United Kingdom ..... 9022754

[51] Int. Cl.[6] ..... B22C 9/00

[52] U.S. Cl. ..... 164/15

[58] Field of Search ..... 164/522, 15, 527, 164/528

[56] References Cited

U.S. PATENT DOCUMENTS

| | | | |
|---|---|---|---|
| 1,751,482 | 3/1930 | Leasman | 106/38.9 |
| 3,764,575 | 10/1973 | Anderko | 164/132 |
| 3,968,828 | 7/1976 | Toeniskoetter | 164/528 |
| 4,070,195 | 1/1978 | Toeniskoetter | 164/528 |
| 4,078,599 | 3/1978 | Makiguchi | 164/522 |
| 4,602,667 | 7/1986 | Moore | 164/528 |
| 4,768,567 | 9/1988 | Travillian | 164/349 |

FOREIGN PATENT DOCUMENTS

| | | | |
|---|---|---|---|
| 725541 | 1/1966 | Canada | 164/522 |
| 53-81429 | 7/1978 | Japan | 164/522 |
| 54-96425 | 7/1979 | Japan . | |

*Primary Examiner*—P. Austin Bradley
*Assistant Examiner*—James Miner
*Attorney, Agent, or Firm*—Roylance, Abrams, Berdo & Goodman, L.L.P.

[57] ABSTRACT

A water dispersible mould for making a casting, the mould comprising a water-insoluble particulate material-and a binder therefor, the binder including polyphosphate chains and/or borate ions. The invention also provides a process for making a water dispersible mould for making a casting, the process including the steps of: (a) providing a water-insoluble particulate material; (b) combining the particulate material with a binder including polyphosphate chains and/or borate ions, the chains and/or ions being dissolved in water; (c) forming, either during or after step (b), the particulate material and binder mixture into a desired shape; and (d) removing free water from the mixture. The polyphosphate chains may be derived from a water soluble phosphate glass and the borate ions may be derived from a soluble borate glass.

36 Claims, No Drawings

WATER DISPERSIBLE MOULDS

This invention relates to water dispersible moulds for use in making foundry castings or injection mouldings.

The term "mould" as used in this specification includes both a mould for producing castings with or without cavities, and a core for producing a cavity in a cavity-containing casting, and combinations of such moulds and cores. The term "casting" used in the specification encompasses foundry casting and other moulding processes such as injection moulding.

Cores and moulds are made from sand or other refractory particulate materials and it is customary to add binders in order to give the necessary properties of flowability (to enable the core/mould to be formed), stripping strength (to enable cores/mould to be handled soon after forming) and the ultimate strength to withstand the conditions occurring during Casting.

The refractory particulate materials and binder are formed into a core or mould by various processes which include ramming, pressing, blowing and extruding the mix into a suitable forming means such as a core box, a moulding flask, or a moulding or mould box. A mould is generally left in the forming means or alternatively it may be removed therefrom; a core is removed from the forming means, optionally after a curing step in which the core is cured to a higher strength than the green strength. If the Curing step is omitted the core requires sufficient green strength so that on removal from the forming means the mixture does not collapse. The core or mould is then allowed to cure, artificially cured or baked to further increase its strength so that it will resist the pressure and erosion effects of the molten metal and retain its shape without breakage or distortion until the metal has solidified. Some binders for the refractory particulate materials result in cores which are difficult to remove from the cavity after casting. Some cores, particularly those employing a sodium silicate binder, increase in strength when exposed to high casting temperatures. The result is that the core is not water dispersible and is difficult to break up mechanically in order to remove it from the casting.

It is well known to employ, for the production of castings, cores or inserts made from a ceramic composition around which the metal or alloy is cast. The cores or inserts are removed after casting by mechanical means, for example by percussion drilling, or in the case of complex shapes or fragile castings by dissolution in a solvent which does not react with the metal of the casting. Alternatively, if an organic binder is used the casting and core may be heated to a temperature approaching the melting point of the casting to break down the organic binder.

A suitable core must satisfy a range of requirements. For instance, it must be capable of being shaped and of maintaining that shape throughout the casting process; it must withstand elevated temperatures; it must be removable from the casting without damaging the casting; and it must be made of a material or materials that do not damage or weaken the casting. The core must also be stable and provide a high quality surface finish.

U.S Pat. Nos. 3,764,575, 3,963,818 and 4,629,708 each disclose methods for using dispersible cores in a casting process, For instance U.S Pat. No. 4,629,708 uses a mixture of a water soluble salt, a calcium silicate and a binder. Examples of suitable materials of the water-soluble salt include potassium chloride, sodium metasilicate or preferably sodium chloride. The binder may be a paraffin wax, a synthetic organic resin, a silicone resin or preferably polyethylene glycol. The mixture is injection moulded and then fired to drive off organics and to sinter particles of the water soluble salt. After casting the core is removed by dissolution in water. The nature of the core material means that time needed for removal of the core can be commercially unacceptable. The solution being in Contact for a relatively long period with the casting can cause corrosion.

U.S Pat. No. 3,764,575 discloses a core comprising a water soluble salt, such as alkali or alkali earth metal chlorides, sulphates or borates, water-glass and synthetic resin as binder.

U.S. Pat. No. 3,963,818 claims to avoid the corrosion problem mentioned above. This specification discloses compressing a dried inorganic salt, such as sodium chloride, at a pressure between 1.5–4 tons per square centimetre. However it has been found that under practical foundry conditions corrosion does occur when a compressed inorganic salt is dissolved. Further the compression moulding technique for forming the core limits the range of cores that can be used as it does not allow complex cores to be formed. Also such cores tend not to be sufficiently strong for high pressure die casting.

The use of cast cores of sodium silicate has also been suggested. However this involves the formation of a melt at a relatively high temperature, and the cast core has a relatively low solubility so that removal with water takes long time, Contact with hot metal can also cause incipient cracks in the core, which result in the casting having an irregular surface. The use of phosphate salts i.e. crystalline phosphate materials such as sodium phosphate has been suggested in U.S. Pat. No. 1,751,482, but this material does not give a stable mould.

Green sands moulds used for producing cavity free castings have gained a widespread acceptance because of their low cost and superior mouldability. In such moulds, the green strength is achieved primarily by shaping the mixture of sand and a binder such as bentonite by a mechanical force. Such moulds may be difficult to use when producing large castings e.g. from cast iron as the silica sand reacts with oxidised iron to form iron silicate which tends to adhere to the resulting casting. This means that the casting must be finished after casting by a process such as shot blasting which produces vibration, noise and dust. Self-curing moulds can be produced using various binders but conventional self-curing moulds are water insoluble, and the casting must often be released from the mould by applying a heavy impact to the mould. This involves heavy vibration, noise and dust which all worsen the working environment.

According to the invention, there is provided a water dispersible mould for making a casting, the mould comprising a water-insoluble particulate material land a binder therefor, the binder including polyphosphate chains and/or borate ions.

Preferably, the polyphosphate chains and/or borate ions have been respectively derived from at least one water soluble phosphate and/or borate glass.

In one preferred embodiment, the binder has been mixed with the particulate material in the form of an aqueous solution of the at least one water soluble glass. In another preferred embodiment, the binder has been mixed with the particulate material in the form of particules of the at least one water soluble glass and the polyphosphate chains and/or borate ions have been formed by mixing water with the mixture of particulate material and glass particles. The glass particles may be wholly or partially dissolved into the water thereby to form the polyphosphate chains and/or borate ions, The water-soluble glass may be wholly vitreous or partially devitrified, in the latter case the water-soluble glass having been heated and cooled thereby to form crystalline regions in an amorphous or glassy phase.

Without wishing to be bound by theory, it is believed that the polyphosphate chains are formed following the dissolution of the respective water soluble glasses into aqueous solution. These chains form an interlinking matrix throughout the mould, which is enhanced by hydrogen bonding of the chains by chemically bonded water molecules. After removal of excess water, the resulting dried mould retains the polyphosphate matrix which firmly binds together the water-insoluble particulate material. If excess water were not removed, the resulting wet mixture could be structurally weakened by the presence of water and would generally not be usable as a mould or core. In addition, the excess water would generate steam during the casting process which, as is well known in the art, would degrade the quality of the resultant casting.

Generally, the principal component in a mould is a water-insoluble particulate material which may be a refractory such as a foundry sand e.g. silica, olivine, chromite or zircon sand or another water-insoluble particulate refractory material such as alumina, an alumino-silicate or fused silica. The silica sands used for foundry work usually contain 98% weight $SiO_2$. The mould may also contain minor amounts of other additives designed to improve the performance of the mould.

Preferably, the binder comprises at least 0.25% by weight, and the particulate material comprises up to 99.75% by weight, of the total weight of the particulate material and the binder. More preferably the binder comprises from 0.5 to 50% by weight, and the particulate material comprises from 99.5 to 50% by weight, of the total weight of the particulate material and the binder.

The present invention also provides a process a water dispersible mould for making a casting, the process including the steps of:

(a) providing a water-insoluble particulate material;

(b) combining the particulate material with a binder including polyphosphate chains and/or borate ions, the chains and/or ions being dissolved in water;

(c) forming, either during or after step (b), the particulate material and binder mixture into a desired shape; and (d) removing free water from the mixture.

Preferably, the water soluble phosphate glass comprises from 30 to 80 mol % $P_2O_5$, from 20 to 70 mol % $R_2O$, from O to 30 mol % MO and from 0 to 15 mol % $L_2O_3$, where R is Na, K or Li, M is Ca, Mg or Zn and L is Al, Fe or B.

As described hereinabove, it is believed that the polyphosphate chains and/or borate ions form an interlinking matrix which may additionally include hydrogen bonding by chemically bonded water molecules. Preferably, the water removing step (d) simply removes free water and not chemically bound water from the mixture. Generally, full removal of chemically bound water is undesirable as this would destroy the hydrogen bonding and thus weaken the structure. However, in some circumstances it may be desirable to remove chemically bound water, and this can be done, for example for a binary $Na_2O/P_2O_5$ glass, by heating at 350° C. once all tree water has been removed at a lower temperature such as at about 150° C.

The present invention further provides a process for making a water dispersible mould for making a casting, the process including the steps of:

(a) providing a water-insoluble particulate material:

(b) combining the particulate material with a binder derived from at least one water soluble phosphate and/or borate glass and water: (C) forming, either during or after step (b), the particulate material and binder mixture into a desired shape; and (d) removing water from the mixture.

The use of a phosphate or borate glass to form the sole binder avoids the use of any organic materials which would volatilise or burn out when the mould is heated at high temperatures.

The invention is of particular value in forming cores for use in casting processes involving the formation of cavities. Such cores are normally formed in core boxes.

In one embodiment, in step (b) the binder which is mixed with the particulate material is in the form of an aqueous solution of the at least one water soluble glass.

In another embodiment, in step (b) the binder which is mixed with the particulate material is in the form of particles of the at least one water soluble glass and the polyphosphate chains and/or borate ions are formed by mixing water with the mixture of refractory particulate material and glass particles.

In the second embodiment, the water may be added in an amount of up to 13% by weight based on the total weight of the mixture. The water may be added either before, during or after the mixture is blown into a mould box during the forming step.

When the water is added to the mixture during or after the delivery of the mixture into the mould box the water is typically added in the form of steam or as a fine water spray. The steam or spray is preferably forced through the mixture under pressure to ensure that the mixture is sufficiently wetted. However when using a core box it has been found preferable to wet the mixture before transferring to the core box.

The moistened glass particles or mixture of glass particles with sand form a flowable mixture even in the presence of the added water. We believe that the water causes sufficient dissolution of the glass surface to provide polyphosphate chains and/or borate ions which interact to form a matrix which tends to cause a gelling action or adhesion of one refractory particle to another. This results in a compacted core which is transferable from the core box, and after removal of free water is handleable without damage under normal foundry working conditions.

The quantity of water used should be such as to ensure the mixture is sufficiently wetted so that the refractory particles adhere to one another. As the glass content is increased more water becomes necessary to wet all the glass particles. If the water is to be introduced before the sand is mixed with the glass then care must be taken to add the glass to the water and not vice versa to ensure an adequate consistency. With high glass amounts (i.e. greater than 5%), if enough water is added to disolve completely all glass (i.e. greater than 5%) before or whilst the mixture is being delivered into the core box the mixture will become too wet and sticky and as a result the mixture will tend to become a coherent mass which will not flow into the core box used to shape the core.

In general at most particle sizes we have found that no problems are experienced when the amount of water is not more than 13% by weight. Selection of a particular water content will also depend on the amount of time the water is left in contact with the mixture (especially if the water is added before the core mixture is delivered into the core box), temperature and the solubility of the glass used. Generally the higher the water content the stronger the resultant core tends to be. The appropriate amount of water to use in particular circumstances can be determined in relation to the particular parameters by relatively simple tests. The amount of water may be controlled in relation to the type and amount of glass present. Thus, the water may be sufficient completely to dissolve all of the glass particles or alternatively may only partially dissolve the glass particles thereby to leave residual glass particles in the mould or core. Typically, for both a coarse foundry sand (i.e. AFS 50) and a fine foundry sand (i.e. AFS 100) we have found that the preferred weight ratio of glass: water is 1:1–1.5 when water is added to a mixture of glass particles and sand.

The core may also be coated to improve the resultant finish on the casting, however care must be taken to ensure that the coating does not contain free or excess water as this could degrade the core.

Preferably, the water soluble phosphate glass comprises from 30 to 80 mol % $P_2O_5$, from 20 to 70 mol % $R_2O$, from 0 to 30 mol % MO and from 0 to 15 mol % $L_2O_3$, where R is Na, K or Li, M is Ca, Mg or zn and L is Al, Fe or B. More preferably, the water soluble phosphate glass comprises from 58 to 72 wt % $P_2O_5$, from 42 to 28 wt % $Na_2O$ and from 0 to 16 wt % CaO.

Such glasses include glasses of the following compositions in weight %:

| | 1 | 2 | 3 | 4 | 5 | 6 |
|---|---|---|---|---|---|---|
| $P_2O_5$ | 70.2 | 67.4 | 64.6 | 61.8 | 59.0 | 60.5 |
| $Na_2O$ | 29.8 | 28.6 | 27.4 | 26.2 | 25.0 | 39.5 |
| CaO | — | 4 | 8 | 12 | 16 | 0 |

As soluble glass, it is preferred to use a glass which has a solution or solubility rate of 0.1–1000 $mg/cm^2/cm^2/hr$ at 25° C. The glass preferably has a saturation solubility at 25° C. of at least 200 g/l, more preferably 800 g/l or greater, for phosphate glasses, and of at least 50 g/l for borate glasses.

The commonly available phosphate glasses are those from the binary system $Na_2O{\cdot}P_2O_5$. The selection of glasses containing $K_2O$ or mixed alkali metal oxides can be made on the same basis but glasses containing $K_2O$ and/or mixtures of alkali metal oxides are less likely to be satisfactory as they are more prone to devitrification, and are also likely to be more costly.

A preferred glass is a phosphate glass from the binary system $Na_2O{:}P_2O_5$, with a molar ratio in the vicinity of $5Na_2O$ to $3P_2O_5$. Although such glasses can vary slightly in composition, we have satisfactorily used a glass containing $P_2O_5$ 60.5 weight %, $Na_2O$ 39.5 weight %. Such a glass has phosphate chains with an average value of n=4.11, n being the number of phosphate groups in the chain.

Glasses with longer chain lengths such as n=30 when used as a binder give moulds with a satisfactory strength to withstand the conditions encountered in both handling the mould and using it for casting but can produce a mould which after use in certain casting processes such as die casting of aluminium requires relatively longer treatment with water to achieve disintegration and removal. Typically a mould made with a glass with a chain length of about 30 requires about 10 minutes soaking in water and 30 seconds flushing with water for removal, compared to less than 1 minute soaking in water and 30 seconds flushing for a glass with a chain length of about 4. Thus where quick removal is required the shorter chain length glass is preferred.

We have carried out a variety of studies in order to assess the suitability of various water-soluble sodium polyphosphate glasses for use as binders. The following table shows compositions of some of the glasses tested:

| Glass Sample Number | Wt % $P_2O_5$ | Wt % $Na_2O$ | Water |
|---|---|---|---|
| 1. | 69.0 | 30.5 | Balance |
| 2. | 67.0 | 32.5 | Balance |
| 3. | 65.0 | 34.5 | Balance |
| 4. | 63.0 | 36.5 | Balance |
| 5. | 60.5 | 39.0 | Balance |
| 6. | 58.0 | 41.5 | Balance |

We have noticed that as the $Na_2O$ content of the sodium polyphosphate glasses increases, the phosphate chain length generally becomes shorter and this in turn tends to increase the tensile strength of the core formed with the phosphate binder. We believe, without being bound by theory, that shorter phosphate chains may be better able to utilise hydrogen bonding and that the more chain end phosphate groups present may give stronger hydrogen bonding. We have also found with sodium polyphosphate glasses that as $Na_2O$ content increases the dispersibility of a core employing such glasses as a binder tends to increase. We believe that this may indicate that the ability of partially hydrated glass to fully rehydrate and dissolve into solution is affected by small changes in composition.

In addition, we have found that as the $Na_2O$ content increases, the viscosity of the solution of the sodium polyphosphate glass in water also tends to increase. We believe that this tendency for an increase of viscosity may possibly indicate the tendency to have hydrogen bonding in aqueous solution. This in turn may possibly indicate that viscosity may indicate the suitability of a given sodium polyphosphate glass to be effective as a binder to give good solubility and tensile strength. As specified hereinbefore, the glass must have a sufficiently high saturation solubility and solubility rate to enable it quickly and sufficiently to go into aqueous solution. We have found that all the glasses specified in the above Table have sufficient solubility rates and saturation solubility values. We have also found that an important practical aspect of the choice of polyphosphate glasses for forming cores is related to the shelf life which the core will be required to be subjected to in use. We have found that as the $Na_2O$ content of the sodium polyphate glass increases, the tendency for the resultant core to be at least partially rehydrated by atmospheric moisture can increase, this leading to a consequential reduction in the tensile strength of the core thereby reducing the effective shelf life of the core. If the tensile strength is reduced in this manner the core may bleak prior to the casting process or may degrade during casting. Furthermore, we have found that the suitability of the various sodium polyphosphate glasses in any given casting process can depend on the temperature to which the resultant core is subjected during the casting process. We believe that this is because the temperature of the casting process can affect the binder in the core having consequential implications for the dispersibility of the Core. For the use of a sand core during aluminium gravity die casting, the centre of a core may be subjected to temperatures of around 400° C. but the skin of the core may reach temperatures as high as 500° C. The dispersibility of cores generally decreases with increasing temperature to which the cores have been subjected. In addition, the variation of dispersibility with composition may vary at different temperatures. We believe that indispersibility of the core after the casting process may be related to the removal of all combined water in the core which was previously bound with the sodium polyphosphate binder. In order to assess water loss of various sodium polyphosphate binders we carried out a thermogravimetric analysis on hydrated glasses. A thermogravimetric analysis provides a relationship between weight loss and temperature. Thermogravimetric analyses were carried out on a number of sodium polyphosphate glasses and it was found that in some cases after a particular temperature had been reached there was substantially no further weight loss which appeared to suggest that at that temperature all combined water had been lost from the glass. We have found that if this temperature is lower than the temperature to which the core is to be subjected to during a casting process, this indicates that the core may have poor post-casting dispersibility resulting from excessive water removal from the core during the casting process. A suitable core binder also requires a number of other features in order to be able to produce a satisfactory core, such as dimensional stability, absence of distortion during the casting process, low gas evolution and low surface erosion in a molten metal flow.

Overall, it will be seen that there are a variety of factors which effect the choice and suitability of a binder.

For any given application, the choice of a binder can be emperically determined by a trial and error technique. However, the foregoing comments give a general indication as to the factors affecting the properties of the binder. What is surprising is that from the combination of these factors, an inorganic binding material, such as a polyphosphate, can be subjected to the temperatures involved in a casting process and still remain readily soluble so as to enable a sand core which is held together by a binder of the polyphosphate material rapidly to be dispersed in water after the high temperature casting process.

Preferably, in the forming step the mixture is blown into a core box by a core blower.

Preferably in step (b) the binder comprises at least 0.25% by weight, and the particulate material comprises up to 99.75% by weight, of the total weight of the particulate material and the binder. More preferably in step (b) the binder comprises from 0.5 to 50% by weight, and the material comprises from 99.5 to 50% by weight, of the total weight of the particulate material and the binder.

When the particle size of the particulate material is relatively small, a relatively large amount of binder will be required in order to ensure that the binder matrix binds together the larger number of particles which provide a correspondingly large surface area.

It has been found where the amount of binder is relatively small as compared to the quantity of sand or other particulate material, it is preferable to introduce the water and glass in the form of a solution of the glass in water. Typically, for a coarse foundry sand (i.e. AFS 50) we have found that the preferred weight ratio of glass: water is 1:0.75-1 when producing a glass solution, and the equivalent glass:water ratio for a fine foundry sand (i.e. AFS 100) is 1:1-1.5. The glass in a powdered form is simply added to water and mixed with a high shear mixer to achieve full solution. A portion of the solution is then added to the refractory particulate material and mixed thoroughly before e.g. blowing the mixture into a core box preheated to 80° C. with compressed air at a pressure of about 80 pounds per square inch, and then purging with compressed air at ambient temperature for about 50 seconds. Cores with good handling strengths are obtained in this manner. Moulds can also be formed.

The removal of water from the mould can be carried out in a number of ways. In the case of a core, the initial treatment of the core while in the core box can reduce the time needed to complete removal of water when the core is removed from the box. A preferred route is to heat the core box to a temperature in the range 50°–90° C. and purge with compressed air at a pressure of 80 pounds per square inch for 30 seconds to 1 minute depending on core size and glass composition. The core is then transferable without damage to an oven where final removal of free water can be accomplished by heating at a temperature in the range 120° C. to 150° C.

Using an unheated core box and a compressed air purge having a pressure in the range 60–80 pounds per square inch, it is necessary to leave the core about 4 minutes while purging to obtain a handleable core. Compressed air at a temperature in the range 50° to 90° C. and a pressure of about 80 pounds per square inch can also be used, and in this case the core is transferable after about 1 minute. We have found that by using glass solutions, when the pro-heat temperature of the core box is greater than 100° C. the compressed air purge time can be reduced to about 10–15 seconds and no final drying step is required. If a cure box is made of a material which is substantially transparent to microwaves e.g. an epoxy resin, the box containing a core may be transferred to a microwave oven and the core dried in about two minuses using a power of about 700 watts and the final drying step in an oven at 120° C. to 150° C. is not needed. Vacuum drying at a temperature of about 25° C. (room temperature) and a vacuum of 700 mm Hg can also be used. A further alternative is to blow cold i.e. room temperature dried air through the core for a period of approximately 4 to 20 minutes.

The removal of the mould after casting may be simply carried out soaking the casting in a water bath and then flushing the casting with water. The use of water at high pressure in the case of a core encourages the dispersion of the core, especially when intricate moulds are being used. The presence of a wetting agent in the water used to form the core may assist this dispersion. Alternatively, if the presence of a low concentration of alkali ions is tolerable, a small proportion of sodium carbonate in the mould mixture, preferably sodium carbonate decahydrate so that it does not absorb water, may assist the dispersion of the core especially if a dilute acid, such as citric acid is used to flush the core.

The following examples illustrate but do not limit the invention.

32 grams of Chelford 50 sand available from BIS was mixed with 8 grams of a glass having a weight percentage composition of $P_2O_5$ 67.4%, $Na_2O$ 28.6% and CaO 4%. The glass was in the form of particle sizes ranging from 150 to 500 micrometres. 1 gram of water was added to the glass and sand and mixed in thoroughly. The core composition was 80 wt % Sand, 20 wt %.

The mixture was then core blown at a pressure of 80 pounds per square inch. After 10 minutes in the mould the core, which was still slightly soft, was removed and heated at 150° C. for 30 minutes to give a core with good structure and definition.

The core was then used as a cavity former in a foundry casting. Aluminium at about 680° C. was poured around the core and allowed to cool. Once cool the casting was flushed with water to remove the glass/sand core. The resulting cavity conformed to the shape of the core and showed no signs of unacceptable surface damage.

EXAMPLES 2 AND 3

The following mixtures were prepared in the same way as the mixture. Example 1 and used to produce foundry castings in accordance with the method of Example 1 except that they were core blown at a pressure of 60 pounds per square inch:

| Example | Chelford 50 sand (grams) | Glass* (grams) | Glass particle size (micrometers) | Water (grams) |
|---|---|---|---|---|
| 2 | 36 (90 wt %) | 4 (10 wt %) | 75–250 | 1 |
| 3 | 32 (80 wt %) | 8 (20 wt %) | 150–500 | 0.5 |

*The glass composition is the same as that used in Example 1. The figures in brackets after the sand and glass masses indicate the ratio of sand:glass in the cores.

A glass/sand mixture was prepared using 32 grams of Chelford 50 sand and 8 grams of a glass having the same composition as that used in Example 1. The glass was in the form of particles in the range 75–250 micrometers.

The resulting dry mixture was then core blown at a pressure of 80 pounds per square inch. 1 gram of water in the form of steam was then added to the core box containing the dry mixture of sand and glass. After 6 minutes in the core box the core, which was still slightly soft, was blasted with air at 150° C. whilst still in the core box. This produced a handleable core which was then removed from the core box and placed in an oven at 150° C. for 30 minutes to give a core with good structure and definition. The core contained 80 wt % sand, 20 wt % glass. The core was then used in accordance with the foundry casting process of Example 1.

EXAMPLE 5

36 grams of a first glass having a weight percentage composition of $P_2O_5$ 61.8%, $Na_2O$ 26.2% and CaO 12.0% was added to 4 grams of a second glass of a higher solubility having weight composition of $P_2O_5$ 70.2%, $Na_2O$ 29.8%. The two glasses were in the form of particle having sizes in the range 75–250 micrometers . The glasses were mixed and 2 grams of water was added to the glasses; the resultant mixture was stirred vigorously for 1 minute. The resultant glass composition was 90 wt % glass of the first composition, 10 wt % glass of the second composition. In this example the lower solubility glass acts as the inert refractory and could be regarded as equivalent to the refractory sand in the earlier Examples. The mixture was then used to produce foundry casting in accordance with the method of Example 1 except that the core was heated at 110° C. for 20 minutes to drive off excess water.

EXAMPLE 6

20 grams of Chelford 60 sand was mixed with 20 grams of a glass having a weight percentage composition of $P_2O_5$ particles in the following sieve fractions by weight:

| | |
|---|---|
| 33.2% | 355–500 micrometers |
| 7.9% | 250–355 micrometers |
| 37.0% | 150–250 micrometers |
| 12.2% | 75–150 micrometers |
| 7.1% | 53–75 micrometers |
| 2.6% | less than 53 micrometers |

The dry mixture was spread evenly over a plastic sheet and 3 grams of water was sprayed (to avoid coagulations) evenly over the mixture. The wetted mixture was then gathered together and mixed in a breaker. The core composition was 50 wt % sand, 50 wt % glass.

The mixture was core blown at a pressure of 80 pounds per square inch into a core box. After three minutes the core and core box were transferred to a second core blower which "bled" compressed air (at ambient temperature) through the core for 4 minutes at a pressure of 50 pounds per square inch. In this specification, the term "ambient temperature" means a temperature of approximately 25° C. The core was then removed and heated at 110° C. for 20 minutes after which the core was ready for use in the foundry casting process of Example 1.

EXAMPLE 7

5 grams of a glass having a weight percentage composition of $P_2O_5$ 70.2% and $Na_2O$ 29.8% was added slowly to 2 grams of water, stirring continuously. The glass was in the form of particles in the range 50–500 micrometers. The resultant slurry was then mixed with 35 grams of Chelford 50 sand.

The mixture was then used to produce a core in accordance with the method of Example 6 which core was then used to produce a foundry casting in accordance with the method of Example 1. The core composition was 87.5 wt % sand, 12.5 wt % glass.

EXAMPLE 8

36 grams of Chelford 60 sand was mixed with 40 grams of the glass used in Example 7. 2 grams of water was then mixed into the glass and sand. The mixture was then used to produce a core in accordance with the method of Example 6, which core was then used to produce a foundry casting in accordance with the method of Example 1. The core composition was 90 wt % sand, 10 wt % glass.

4 grams of Chelford 60 sand was mixed with 36 grams of a glass having a weight percentage composition of $P_2O_5$ 64.6 wt %, $Na_2O$ 27.4% and CaO 8.0%. The glass was in the form of particles in the range 75–250 micrometers. 4 grams of water was added to the glass and sand and mixed thoroughly. The core composition was 10 wt % sand, 90 wt % glass.

The mixture was then used to produce a core in accordance with the method of Example 6, except that a second core blower "bled" compressed air heated to 50° C. at a pressure of 50 pounds per square inch for four minutes through the core. The core was then used to produce a foundry casting in accordance with the method of Example 1.

EXAMPLE 10

36 grams of Chelford 60 sand was mixed with 4 grams of a glass having a weight percentage composition of $P_2O_5$ 70.2% and $Na_2O$ 29.8%. The glass was in the form of particles of size hot greater than 500 micrometres. 1.2 grams of water was added to the dry mixture and mixed in a beaker. The core composition was 90 wt % sand, 10 wt % glass.

The resultant mixture was then core blown-at a pressure of 60 pounds per square inch into an epoxy resin core box. The core box, with the core inside, was immediately transferred to a 700 Watt microwave oven and heated at maximum power for 2 minutes. The core was then removed from the core box and was ready for use in the foundry casting process of Example 1.

EXAMPLE 11

95 grams of AFS 100 sand was mixed with 5 grams of a glass having a weight percentage composition of $P_2O_5$ 60.5%, $Na_2O$ 39.5%. The glass had a particle size of less than 500 microns. 4 grams of water was added to the dry mixture and the whole thoroughly mixed. The mixture was then blown with compressed air at a pressure of 80 pounds per square inch into a metal core box which has been proheated to 70° C. The core was dried to a handleable form by purging the box with compressed air at ambient temperature and a pressure of 80 pounds per square inch. The core was then removed and placed in an oven at 150° C. for 30 minutes to remove any residual free water before casting. The core on removal from the oven was tested and found to have a tensile strength of 160 pounds per square inch and, a compressive strength of 1040 pounds per square inch.

EXAMPLE 12

Example 11 was repeated with the additional step of placing the core after drying in an oven at 350° C. for 30 minutes to ensure that it was rendered completely water free.

EXAMPLE 13

Example 11 was repeated with a different glass composition having a weight percent composition $P_2O_5$ 70.2%, $Na_2O$ 29.8%. It was found that when the core was removed from the drying oven, in order to ensure it was entirely water free, it was necessary to heat at 350° C. for 30 minutes.

EXAMPLE 14

15 grams of a glass having a weight percentage composition of $P_2O_5$ 70.2%, $Na_2O$ 29.8% with the same particle size range as the glass used in Example 6 was mixed with 285 grams of AFS 100 sand. 12 grams of tap water was then added and mixed thoroughly into the mixture. The mixture was then blown with compressed air at a pressure of 80 pounds per square inch into a core box heated to 60° C. Compressed air at ambient temperature was then blown through the heated box for 60 seconds. The core could be extracted immediately from the box because of its good handling characteristics, and was transferred to an oven at 150° C. for further drying.

EXAMPLE 15

A glass/sand mixture was prepared using 90 grams of AFS 100 sand, and 10 grams of a particulate glass having a weight % composition $P_2O_5$ 70.2%, $Na_2O$ 29.8%. 4 Grams of tap water was added to the mix, and mixing carried out thoroughly. The mixture was then blown into a core box using compressed air at a pressure of 80 pounds per square inch. The resulting core had a good compaction and structure and was ready for further drying before being used in casting. A similar result was obtained using a glass/sand mixture which contains 95 grams AFS 100 sand, and 5 grams of glass having the weight percent composition $P_2O_5$ 60.5%, $Na_2O$ 39.5% and was mixed with 4 grams of water and blown into the core at a pressure of 50 pounds per square inch. This latter mixture had improved flow characteristics compared to the first mixture which permitted a lower blowing pressure to be used.

EXAMPLE 16

60 grams of a powdered glass having a weight percent composition $P_2O_5$ 60.5%, $Na_2O$ 39.5% was added to 100 ml of cold tap water and mixed in a high shear blender for 10 seconds to dissolve it properly. 2.6 grams of this solution which gives a final binder content of 1.0 wt % by weight of the total weight of the mix was added to 97.4 grams of AFS 50 sand, and the two mixed thoroughly for 1 minute in a high shear mixer, e.g. a Kenwood Chef (Registered Trade Mark) mixer, at about 120 revs/minute for 1 minute. The mixture was then blown into a core box heated to 80° C. with compressed air at a pressure of 80 pounds per square inch. The core box was then purged with compressed air at a pressure of 80 pounds per square inch and at ambient temperature for 50 seconds. The core on extraction was in the shape of a dog bone shaped test piece and after removal of residual moisture by being held at 150° C. for 30 minutes was found to have a tensile strength of 196 pounds per square inch.

EXAMPLE 17

60 grams of a powdered glass having a weight percent composition $P_2O_5$ 60.5%, $Na_2O$ 39.5% was added to 100 ml of cold tap water and mixed in a high shear mixer for 10 seconds to achieve full solution. 5 grams of the above solution which gives a final binder content of 2 % by weight of total weight of mixture was added to 95 grams of AFS 100 sand, and mixed for 1 minute at 120 revs/minute in a mixer. The mix was then blown into a core box heated to 80° C. with compressed air at a pressure of 80 pounds per square inch. Compressed air at 80 pounds per square inch wan then purged through the core box for 30 seconds, and a dog bone shaped test piece was then extracted with a good handling strength. A further 9 pieces were made using the remainder of this mix and further identical mix. Residual moisture was removed from each piece by heating at 150° C. for 30 minutes.

The 10 dog bone test pieces were strength tested on an 'Instron 1195' strength measuring machine in tension mode, using a 5KN load cell and a cross-head speed of 5 mm/min. The average of the 10 results was 202 N which is equivalent to a tensile strength of 163.9 pounds per square inch.

A further mix of an identical composition was made. This was compacted to form small cylindrical shaped test pieces suitable for measuring compressive strength. These pieces were similarly dried at 150° C. for ½ hour. Ten identical test pieces were strength tested on an 'Instron 1195' in compassion mode, using a 50KN load cell and a cross-head speed of 2 mm/min. The average of the 10 results was equivalent to a compressive strength of 1180 pounds per square inch.

EXAMPLE 18

This Example illustrates the fabrication of a small sand mould for casting small aluminium shapes. 20 g of a glass having the composition $P_2O_5$ 60.5 wt % and $Na_2O$ 39.5 wt % was added to 30 mls of water and mixed in a high shear mixer for 10 seconds to achieve full solution. 2.5 g of the above solution was added to 97.5 g of AFS 50 sand and mixed thoroughly in a rotary orbital mixer with a hollow blade. The resultant mixture was compacted into a steel former, which was essentially cylindrical, and a shaped steel punch was pushed through the mixture providing an internal hole into which molten aluminium would be poured. The formed mixture was tapped gently out of the former and transferred to an oven at 150° C. for ½ an hour. The mould was then ready for the casting process. The mould weighed 60 g and had a glass content of 1 wt %.

EXAMPLE 19

Example 18 was repeated but only 1.25 g of the solution was added to 98.75 g of AFS 50 sand. The resultant mould had a glass content of 0.5 wt %.

EXAMPLE 20

Example 18 was repeated again but only 0.625 g of the solution was added to 99.375 g of AFS 50 sand. The resultant mould had a glass content of 0.25 wt %.

EXAMPLE 21

20 g of a powdered glass of composition $P_2O_5$ 60.5 weight % and $Na_2O$ 39.5 weight % was added to 30 mls of cold tap water and mixed in a high-shear mixer for 10 seconds to achieve full solution. 30 g of the above solution was mixed thoroughly with lkg of AFS 100 foundry sand in a rotary orbital mixer with a hollow blade. The resultant mixture was blown into a wooden core box, which was not heated, at 50 pounds per square inch. Compressed air, at 50 pounds per square inch, was then purged through the inlet orifice of the core box top for 10 minutes. The core box was then inverted and compressed air, at 50 pounds per square inch, was purged through a similar size orifice in the core box base, also for 10 minutes. On removal from the core box, the core, which has good handling strength, was transferred to an oven at 150° C. for 1 hour. The core which was 600 g in weight contained 1.8% by weight of the soluble phosphate glass. The core, which was cylindrical in shape, was then ready for the casting process. This Example illustrates the use of low temperatures to remove water from the core prior to the high temperature core strengthening step.

EXAMPLE 22

The same mixture as Example 21 was blown into the same wooden core box at a pressure of 50 pounds per square inch. The core box was not heated. Immediately after blowing, the core box was separated into two parts along a horizontal plane so that a soft core remained in the bottom half of the core box. The full core within the half core box was transferred to a vacuum oven which was at 600° C. The pressure was reduced by 700 mm Hg and held for 3 hours. The vacuum was then released and the core was extracted from the half core box, fully dried and ready for the casting process.

EXAMPLE 23

95 grams of AFS 80 sand was mixed with 5 grams of a borate glass having a mol % composition of $B_2O_3$ 62 mol %, $Na_2O$ 38 mol %. 10 grams of water was added to the mix and the whole composition was mixed thoroughly. The resulting mix was blown at a pressure of 80 pounds per square inch into a core box heated to 65° C., and then purged with compressed air at a pressure of 80 pounds per square inch for 120 seconds. The core had an acceptable handling strength and was transferred to an oven for 30 minutes at 150° C. The core was then used to produce a foundry casting from aluminium in the same manner as Example 2. The core was easily removed from the cavity and the cavity conformed to the shape of the core and had an acceptable surface finish.

EXAMPLE 24

4 g of a borate glass having a mol % composition of $B_2O_3$ and 38% $Na_2O$, and a particle size range of less than 250 microns, was thoroughly mixed with 96 q of AFS 100 foundry sand. 5 g of tap water was added and mixed in thoroughly. The resulting mixture was blown into a core box heated to 65° C., and then purged with compressed air at 80 pounds per square inch for 60 seconds. The core, which had acceptable handling strength, was transferred to an oven at 150° C. for ½ an hour. The core was then used in an aluminium gravity die casting process.

EXAMPLE 25

4 g of each of these borate glasses:

| | mol % $B_2O_3$ | mol % $Na_2O$ |
|---|---|---|
| A | 52 | 48 |
| B | 54 | 46 |

at a particle size of less than 250 microns, was mixed with 96 g of an AFS 80 foundry sand. 5 g of tap water was added and mixed in thoroughly. The resulting mixture was blown into a core box heated to 90° C., and then purged with compressed air at 80 pounds per square inch for 90 seconds. The core, which had acceptable handling strength, was transferred to an oven at 150° C. for ½ an hour. The core was then used in an aluminium gravity die casting process.

EXAMPLE 26

20 g of a powdered glass having a mol % composition of 54% $B_2O_3$ and 46% $Na_2O$, was added to 30 mls of 50° C. tap water and mixed in a high-sheer mixer for 10 seconds to achieve full solution. 15 g of the resultant solution was mixed thoroughly with 285 g of an AFS foundry sand for 1 minute in a rotary orbital mixer with a hollow blade. The mixer capacity was 3 liters.

The resulting mixture was blown into a core box heated to 90° C., and purged with compressed air at 80 pounds per square inch for 60 seconds. The core, which had acceptable handling strength, was transferred to an oven at 150° C. for ½ an hour. The core was then used in an aluminium gravity die casting process.

EXAMPLE 27

15 grams of a grass having a weight % composition of $P_2O_5$ 70.2%, $Na_2O$ 29.8% and a particle size of less than 250 microns was mixed thoroughly with 285 grams of an AFS 50 foundry sand. 12 grams of tap water was added and mixed in thoroughly. The resulting mix was blown into a core box at 60° C. using compressed air at ambient temperature and a pressure of 80 pounds per square inch. Compressed air was then blown through the core box at a pressure of 80 pounds per square inch for 1 minute. The core, which has good handling strength, was immediately extracted from the core box, and was transferred to an oven at 150° C. for ½ hour. The core which weighed 270 grams was then located in a gravity casting die for making a 570 gram water pump housing for an automotive application. Aluminium at 700° C. was then poured into the closed die. After 1 minute the die was opened and the aluminium casting was removed with the internal core still intact. The casting (with internal core) was allowed to cool down for 20 minutes and then immersed in a still bath of cold tap water. 10 minutes later the casting was removed from the bath. It was found that approximately 50% of the core had been dispersed during this soak period. The remaining core was soft and required on 30 seconds flushing with a water hose to remove. The resulting water pump casting was free of sand particles and had a good internal surface finish.

EXAMPLE 28

6 grams of a glass having a weight % composition of $P_2O_5$ 70.2%, $Na_2O$ 29.8% and a particle size of less than 250 microns was mixed with 74 grams of an AFS 100 foundry sand. 3.2 mls of tap water was added and mixed in thoroughly. The mix was blown into a core box at 60° C. using compressed air at ambient temperature and a pressure of 80 pounds per square inch. Compressed air was then blown through the core box at a pressure of 80 pounds per square inch for 1 minute. The core, which had good handling strength, was immediately extracted and transferred to an oven at 150° C. for ½ hour. The resulting core was 60 grams in weight, and was disc-shaped with one print-end extending from each face. To eliminate metal penetration during casting, the core was dip-coated with an iso-propyl alcohol (I.P.A.) based zirconium silicate slurry coating. The core was then ready for use in an aluminium high pressure die casting process.

Casting conditions
metal temperature—700±20° C.
metal velocity—39.2 m/s
specific pressure—13,5000 pounds per square inch
fill time—0.05 seconds
gate size—80 $mm^2$.

The resulting casting, which was approximately 300 grams in weight, was removed from the die with the internal core still intact and immersed in a still bath of cold water. 10 minutes later, the casting was removed from the bath. It could be seen that some of the core had fallen out during this soak period. The remaining core was soft and required only 20 seconds flushing with a water jet at a pressure of 80 pounds per square inch to fully remove the last of the core. The resulting aluminium casting was free of sand particles and aluminium penetration, and had a good definition.

EXAMPLE 29

This example uses partially devitrified glass. A molten glass at 800° C. containing 58 wt % $P_2O_5$ and 42 wt % $Na_2O$ was cast on a steel table As the glass melt solified, a devitrified phase formed such that the solid glass contained a mixture of glassy and devitrified phases.

This partially devitrified glass was crushed and sieved to removed particals greater than 50 microns in size. 10 g of this seived powder was mixed thoroughly with 200 g of an AFS 100 foundry sand, using a rotary orbital mixer with a hollow blade. 10 ml of cold tap water was added to the mixture and the resultant wet mixture was mixed thoroughly using the rotary orbital mixer. The resulting mixture formed a charge which was blown into a core box heated to 90° C., using compressed air at a pressure of 70 pounds per square inch.

The blown charge was then purged using compressed air at a pressure of 70 pounds per square inch and at ambient temperature for a period of 90 seconds. The resultant core, which had good handling strength, was then transferred to an oven and heated at 150° C. for 1 hour.

The core was then removed and employed in an aluminium gravity die casting process.

EXAMPLE 30

This example illustrates the use of fused sodium borates as the binders, The fused sodium borates were produced by heating mixtures of sodium carbonate (anhydrous) and orthoboric acid to temperatures within the range 900° C. to 1200° C., preferably at the top of that temperature range. Fused sodium borate binders were also produced from a mixture of sodium tetraborate and sodium carbonate and from a mixture of diboron trioxide and sodium carbonate.

In the preparation of the binders the fused material formed from a selected one of the mixtures listed above was ground to a particle size of less than 500 microns. Two types of binder were formed having different hinder concentrations in the sand.

For a 2 wt % borate concentration in the binder the proportions of the components were: fused borate 2.0 g, water 4.0 g, and sand (AFS 100) 98.0 g, and for a 6 wt % borate concentration in the binder the proportions were: fused borate 6.0 g, water 10.0 g and sand (AFS 100) 94.0 g. Binder solutions were prepared by adding the fused borate powder to water at around 60° C. with vigorous agitation. Appropriate quantities of the binder solution were then mixed with foundry sand using a Kenwood K blade mixer. Portions of the sand/binder mixture were compacted into "dog bone" test pieces using a Ridscale sand rammer. All of the test pieces produced were dried for one hour at 150° C. The resultant examples were then examined for tensile strength and dispersibility.

The results of these examinations are set out below. The mole percent equivalents of Sodium oxide ($Na_2O$) and boron oxide ($B_2O_3$) are shown for the respective binders tested.

| 2% Binder Concentration | | | | | |
|---|---|---|---|---|---|
| Mol % = | | Tensile Strength p.s.i. | | | Dispersion |
| $Na_2O$ | $B_2O_3$ | Max | Min | Average | Time (Sec) |
| 48 | 52 | 275 | 250 | 264 | 10 |
| 42 | 58 | 250 | 225 | 240 | <60 |
| 50 | 50 | 240 | 190 | 206 | 5 |

| 6% Binder Concentration | | | | | |
|---|---|---|---|---|---|
| Mol % ≡ | | Tensile Strength p.s.i. | | | Dispersion |
| $Na_2O$ | $B_2O_3$ | Max | Min | Average | Time (Sec) |
| 48 | 52 | >368 | 340 | 357 | 5 |
| 44 | 56 | 310 | 285 | 301 | 10 |
| 50 | 50 | 330 | 225 | 273 | 5 |

It will be seen that the binders had good tensile strength coupled with low dispersion times.

The tests were repeated on corresponding samples which had been further dried at 400° C. for one hour after the 150° C. drying step. The resultant samples had very low tensile strength of less than about 20 p.s.i. and the dispersion times were generaly longer than those of the corresponding original samples.

EXAMPLE 31

This example illustrates the use of fused potassium borates which were prepared in a similar manner to the sodium borates of Example 30. "Dog bone" test pieces were prepared (with a fusion temperature of 12000 C.), dried, heat treated and tested as in Example 30. The sample having a 2 wt % borate concentration in the binder had a mole percent equivalent concentration of 48 tool % $K_2O$ and 52 mol % $B_2O_3$.

| Mol % ≡ | | Tensile Strength p.s.i. | | | Dispersion |
|---|---|---|---|---|---|
| $Na_2O$ | $B_2O_3$ | Max | Min | Average | Time (Sec) |
| 48 | 52 | 225 | 210 | 243 | <5 |

The sample had good tensile strength and dispersibility. A further sample which was further dried at 400° C. was also tested but this had an average tensile strength of only around 55 p.s.i. and had a dispersion time which was slightly longer than that of the 150° C. dried sample.

EXAMPLE 32

This example illustrates the use of non-fused sodium borate solution binders. In the preparation of a binder solution, sodium hydroxide was added portion-wise to water with vigorous agitation. Boric acid was added in small portions to maintain a temperature of 80° C. to 90° C. A number of samples of binder solution were prepared having different molar percentages of sodium oxide and boron oxide equivalents. Test pieces were then prepared by mixing appropriate quantities of the binder solution with foundry sand (AFS 100) to give a 2% w/w mixture. The addition of further water (50% w/w with respect to the binder solution) was required to obtain a suitable-distribution in the mixture. Dog bones were prepared, dried (for one or two hours at 150° C.) and examined for tensile strength.

The test results are shown below for different binder compositions (having different molar percentages of $Na_2O$ and $B_2O_3$ and for different drying regimes.

| | | Tensile Strength p.s.i. | | | | | |
|---|---|---|---|---|---|---|---|
| Mol % ≡ | | 150° C./1 hr | | | 150° C./2 hr | | |
| $Na_2O$ | $B_2O_3$ | Max | Min | Average | Max | Min | Average |
| 48 | 52 | 210 | 190 | 203 | 210 | 180 | 199 |
| 45 | 55 | 215 | 160 | 181 | 195 | 160 | 177 |
| 50 | 50 | 190 | 140 | 169 | 210 | 180 | 195 |

The samples exhibited satisfactory tensile strength.

EXAMPLE 33

This example illustrates the use of the sodium salt of tetraphosphoric acid as the binder.

Binder solutions containing sodium polyphosphate of mol % $Na_2O:P_2O_5$ ratio 59.6:40.4 (equivalent to sodium polyphosphate glass sample No. 5) were prepared from tetraphosphoric acid and sodium carbonate.

Test pieces (dog bones) were prepared containing 2% w/w solid binder with respect to AFS 100 sand. Tensile strength and dispersibility tests were performed on dried at (150° C. for two hours) and heat treated "dog bones".

The test results are shown below.

| Mol % ≡ | | Tensile Strength p.s.i. | | | Dispersion |
|---|---|---|---|---|---|
| $Na_2O$ | $P_2O_5$ | Max | Min | Average | Time (Sec) |
| 59.6 | 40.4 | 165 | 130 | 146 | <5 |

The samples had satisfactory tensile strength.

Further samples were then prepared which had been further dried at 400° C. These samples had poor tensile strength of less than about 20 p.s.i. and high dispersion times of around 2 minutes.

COMPARATIVE EXAMPLE I

Use of Crystalline Sodium Phosphate 75 grams of a crystalline sodium phosphate with an equivalent weight % composition as the phosphate glass having the composition $P_2O_5$ 70.2 wt %, $Na_2O$ 29.8 wt % was mixed thoroughly with 92.5 grams of AFS 100 foundry sand, and then mixed with 4 grams of tap water. The mixture was blown at a pressure of 60 pounds per square inch into a metal core box which had been preheated to 60° C. Compressed air at ambient temperature was then purged through the core box for 60 seconds. Using the crystalline sodium phosphate, on extraction from the core box, the Core collapsed. An equivalent treatment in the case of the equivalent phosphate glass would have resulted in a core with good handling characteristics.

COMPARATIVE EXAMPLE II

Use of Sodium Silicate Glass 90 gram of AFS 100 foundry sand and 10 grams of a silicate glass having a mol % composition of $Na_2O$ 45 mol %, $SiO_2$ 55 mol % and in the particle size range of 0–250 microns, were mixed. 4 grams of water was added to the above and mixed in thoroughly. The resulting mix was blown into a core box heated to 70° C. at a pressure of 80 pounds per square inch. The cure box was then purged with compressed air at ambient temperature for 90 seconds.

The resulting core had good handling strength and was then dried in an oven at 150° C. for ½ hour. The resulting dried core was 60 grams in weight and was disc-shaped with one print-end extending from each face.

The core was then located in a small gravity casting die which makes 300 gram aluminium castings. The die was closed and molten aluminium at 700° C. was poured into the die. 1 minute later the die was separated and the casting withdrawn with the internal core still intact. The casting was allowed to cool for 10 minutes before being transferred to a stirred bath of tap water at 50° C. One hour later the core was still intact within the casting, and flushing with a water hose did not result in any removal of the core from the casting.

We claim:

1. A water-dispersible mould for making a casting, the mould comprising a water-insoluble particulate material and a binder therefor, wherein the binder contains at least one matrix former selected from the group consisting of polyphosphate chains derived from water-soluble phosphate glass and borate ions.

2. A water dispersible mould according to claim 1 wherein the said at least one matrix former in said binder is borate ions wherein said borate ions are derived from water-soluble borate glass.

3. A water dispersible mould according to claim 2 wherein said at least one matrix former in said polyphosphate claims derived from water-soluble phosphate glass or said borate ions wherein said borate ions are derived from water-soluble borate glass and wherein said water-soluble phosphate glass or said water-soluble borate glass has been partially devitrified.

4. A water dispersible mould according to claim 2 wherein said matrix former in said binder is in the form of an aqueous solution of at least one of said water-soluble glasses.

5. A water dispersible mould according to claim 2 wherein the binder has been mixed with the particulate material in the form of particles of the at least one water soluble glass and said at least one matrix former being formed by mixing water with the mixture of particulate material and glass particles.

6. A water dispersible mould according to claim 2 wherein the water soluble phosphate glass comprises from 30 to 80 mol % $P_2O_5$, from 20 to 70 mol % $R_2O$, from 0 to 30 mol % MO and from 0 to 15 mol % $L_2O_3$, where R is Na, K or Li, M is Ca, Mg or Zn and L is Al, Fe or B.

7. A water dispersible mould according to claim 6 wherein the water soluble phosphate glass comprises from 58 to 72 wt % $P_2O_5$, from 42 to 28 wt % $Na_2O$ and from 0 to 16 wt % CaO.

8. A water dispersible mould according to claim 2 wherein the binder comprises at least 0.25% by weight, and the particulate material comprises up to 9.75% by weight, of the total weight of the particulate material and the binder.

9. A water dispersible mould according to claim 8 wherein the binder comprises from 0.5 to 25% by weight, and the particulate material comprises from 99.5 to 75% by weight, of the total weight of the particulate material and the binder.

10. A water dispersible mould according to claim 1 wherein the particulate material is foundry sand.

11. A water dispersible mould according to claim 1 wherein the mould is a core.

12. A process for casting a castable material, the process comprising making a water dispersible mould according to claim 1, pouring castable material into contact with the mould so as to adopt the surface shape of the mould, and dispersing the mould from the solid cast material by treating the mould with an aqueous liquid.

13. A process according to claim 12 wherein the castable material is liquid metal.

14. A process for making a water dispersible mould for making a casting, the process including the steps of:

(a) providing a water-soluble particulate material;

(b) combining the particulate material with a binder wherein said binder contains at least one matrix former selected from the group consisting of polyphosphate chains derived from a water-soluble phosphate glass and borate ions, said at least one matrix former being dissolved in water;

(c) forming, either during or after step (b), the particulate material and binder mixture into a desired shape; and (d) removing free water from the mixture.

15. A process according to claim 14 wherein the at least one matrix former have been derived from water-soluble glass selected from the group consisting of a water soluble phosphate glass, water-soluble borate glass or water-soluble phosphate glass and a water-soluble borate glass.

16. A process according to claim 15 wherein in step (b) the binder which is mixed with the particulate material is in the form of particles of the water soluble glass and wherein the polyphosphate chains, the borate ions or the polyphosphate chains and borate ions are formed by mixing water with the mixture of particulate material and particles of said water-soluble glass.

17. A process according to claim 16 wherein water is added in an amount of up to 13 % by weight based on the total weight of the mixture.

18. A process according to claim 15 wherein in step (b) the binder which is mixed with the particulate material is in the form of an aqueous solution of the at least one water soluble glass.

19. A process according to claim 15 wherein the water soluble phosphate glass comprises from 30 to 80 mol % $P_2O_5$, from 20 to 70 mol % $R_2O$, from 0 to 30 mol % MO and from 0 to 15 mol % $L_2O_3$, where R is Na, K or Li, M is Ca, Mg or Zn and L is Al, Fe or B.

20. A process according to claim 19 wherein the water soluble phosphate glass comprises from 58 to 72 wt % $P_2O_5$, from 42 to 28 wt % $Na_2$ and from 0 to 16 wt % CaO.

21. A process according to claim 14 wherein in forming step (c) the particulate material and binder mixture is blown under pressure into a mould box thereby to shape the mixture into the desired shape.

22. A process according to claim 21 wherein the mould box is heated before the mixture is blown thereinto.

23. A process according to claim 21 wherein the mixture is blown by means of compressed air.

24. A process according to claim 21 wherein after the mixture has been blown into the mould box the mould box filled with the mixture is purged with compressed purging air.

25. A process according to claim 24 wherein the compressed purging air is at an elevated temperature.

26. A process according to claim 25 wherein the elevated temperature is from 50° to 90° C.

27. A process according to claim 24 wherein the compressed purging air removes the free, non-chemically bound, water from the mixture.

28. A process according to claim 21 wherein in step (d) water is removed from the mixture by heating.

29. A process according to claim 28 wherein the mixture is heated to a temperature in excess of 1000° C. to remove substantially all free, non-chemically bound water from the mixture.

30. A process according to claim 28 wherein the mixture is heated in a hot air oven after removal from the mould box.

31. A process according to claim 28 wherein the mould box is substantially transparent to microwaves and the mixture is heated in the mould box by microwaves.

32. A process according to claim 14 wherein the mould is a core.

33. A process according to claim 14 wherein in step (b) the binder comprises at least 0.25% by weight, and the particulate material comprises up to 99.75% by weight, of the total weight of the particulate material and the binder.

34. A process according to claim 32 wherein in step (b) the binder comprises from 0.5 to 25% by weight, and the material comprises from 99.5 to 75% by weight, of the total weight of the particulate material and the binder.

35. A process according to claim 14 wherein the refractory particulate material is foundry sand.

36. A process for making a water dispersible mould for making a casting, the process including the steps of:

(a) providing a water-insoluble particulate material;

(b) combining the particulate material with a binder wherein said binder is derived from water and at least one glass selected from the group consisting of water soluble phosphate glass and water-soluble borate glass;

(c) forming, either during or after step (b), the particulate material and binder mixture into a desired shape; and (d) removing free water from the mixture.

* * * * *